United States Patent [19]

Norton

[11] Patent Number: 4,559,724

[45] Date of Patent: Dec. 24, 1985

[54] TRACK SHOE WITH A IMPROVED SOLE

[75] Inventor: Daniel E. Norton, Hampton, N.H.

[73] Assignee: Nike, Inc., Beaverton, Oreg.

[21] Appl. No.: 549,657

[22] Filed: Nov. 8, 1983

[51] Int. Cl.[4] ..... A43B 5/00; A43B 5/06; A43B 13/14

[52] U.S. Cl. ..... 36/129; 36/114; 36/59 C; 36/67 D; 36/134

[58] Field of Search ..... 36/114, 129, 127, 128, 36/32 R, 59 C, 126, 134, 670

[56] References Cited

U.S. PATENT DOCUMENTS

| | | | |
|---|---|---|---|
| 1,569,576 | 1/1926 | Raymond . | |
| 1,776,750 | 9/1930 | Burns . | |
| 2,211,057 | 8/1940 | Duckoff | 36/2.5 |
| 2,405,498 | 8/1946 | Gregg | 36/32 |
| 2,547,480 | 4/1951 | McDaniel | 36/19 |
| 2,745,197 | 5/1956 | Holt | 36/134 |
| 2,902,780 | 9/1959 | Bellew | 36/134 |
| 3,818,617 | 6/1974 | Dassler et al. | 36/32 R |
| 3,822,488 | 7/1974 | Johnson | 36/2.5 |
| 4,178,702 | 12/1979 | Mayer | 36/127 |
| 4,184,272 | 1/1980 | Riggs | 36/129 |
| 4,212,120 | 7/1980 | Bowerman et al. | 36/129 |
| 4,262,435 | 4/1981 | Block et al. | 36/129 |
| 4,309,831 | 1/1982 | Pritt | 36/3 B |
| 4,361,971 | 12/1982 | Bowerman | 36/129 |
| 4,364,190 | 12/1982 | Yonkers | 36/32 R |
| 4,380,878 | 4/1983 | Skaja | 36/134 |

FOREIGN PATENT DOCUMENTS

| | | | |
|---|---|---|---|
| 816512 | 8/1951 | Fed. Rep. of Germany | 36/129 |
| 2405091 | 8/1975 | Fed. Rep. of Germany | 36/129 |
| 3233792 | 3/1984 | Fed. Rep. of Germany | 36/129 |

OTHER PUBLICATIONS

Nike Advertisements on Models 2700; 2876; 2930; 2940 and 2950.

*Primary Examiner*—Werner H. Schroeder
*Assistant Examiner*—Steven N. Meyers
*Attorney, Agent, or Firm*—Banner, Birch, McKie & Beckett

[57] ABSTRACT

A track shoe with an improved sole is disclosed. The sole includes a plate formed of a first material which extends along substantially the entire length of the shoe. A plurality of traction cleats are permanently attached to the plate and are formed of a second material having a hardness less than the first material. A plurality of spike fasteners are attached to the forepart portion of the plate and a pair of lateral traction extensions are formed integral with the plate and extend upwardly therefrom adjacent to and upwardly of the fifth metatarsal-phalanges joint. The lateral traction extensions are separated by a gap. First, second and third flex grooves are formed in the plate to enhance the flexibility of the plate along the grooves. The first and second flex grooves extend generally parallel to a line between the first and second metatarsal-phalanges joints. The third flex groove extends substantially parallel with a line extending along the second through fifth metatarsal-phalanges joints.

10 Claims, 6 Drawing Figures

TRACK SHOE WITH A IMPROVED SOLE

TECHNICAL FIELD

The present invention relates to athletic shoes, and in particular, to a track shoe with a single piece spike plate-sole.

BACKGROUND OF THE INVENTION

The modern athletic shoe is a highly refined combination of many elements which have specific functions, all of which must work together for the support and protection of the foot during an athletic event. A shoe is divided into two general parts, an upper and a sole.

The upper is designed to snugly and comfortably enclose the foot. Typically, it will have several layers including a weather- and wear-resistant outer layer of leather or synthetic material such as nylon, and a soft, padded inner liner for foot comfort. Current uppers typically have an intermediate layer of a synthetic foam material. The three layers of the upper may be fastened together by stitching, gluing, or a combination of these. In areas of maximum wear or stress, reinforcements of leather and/or plastic are attached to the upper. Examples of such reinforcements are leather toe sections attached over synthetic inner layers of the toe area and heel counters made of an inner layer of plastic and an outer layer of leather. In competitive track events it is important to keep the weight of the upper as low as possible.

The other major portion of an athletic shoe is the sole. Designed to withstand many miles of running, it must have an extremely durable bottom surface to contact the ground. The ground contact surface of an athletic shoe includes traction elements or cleats to enhance the reaction between the foot and the ground. Enhanced traction is particularly important in competitive track events. Thus, track shoes frequently incorporate spikes in the forepart portion of the sole. The spikes are thin metal projections, which are typically removable from the sole. The forepart portion of the sole of a track shoe is typically made of a relatively hard material such as nylon in order to provide a sturdy base for a socket to hold the spikes, and is typically referred to as a spike plate. Prior art spike plates typically extended only under the forepart portion of the shoe, with the remainder of the sole being formed of a more resilient plastic or rubber material. In track shoes where additional shock absorbency is desired, a more resilient material is extended over the spike plate and the remaining length of the shoe, with appropriately located holes through which the spikes can extend, and a relatively thin shock absorbing midsole layer is added in the heel and arch area.

SUMMARY OF THE INVENTION

The present invention is directed to a sole for a track shoe, and is comprised of a plate formed of a first material which extends along substantially the entire length of the shoe. A plurality of traction cleats are permanently attached to the plate and are formed of a second material which has a hardness less than that of the first material. A plurality of spike fasteners are attached to the forepart portion of the plate.

In a preferred embodiment, the plate is formed of nylon with a first hardness and the cleats are formed of a nylon of less hardness. The fasteners include sockets held within projections from the plate, and the cleats include cleats in the forepart section of the sole. The cleats in the forepart section of the sole are located between the projections from the plate and have a thickness substantially equal to the thickness of the projections in order to serve as a support bridge between the fasteners.

The sole also preferably includes a plurality of flex grooves extending laterally across the plate in order to enhance the flexibility of the plate along the grooves. Two of the flex grooves are aligned parallel to a line which extends between the first and second metatarsal-phalanges joints on the medial side of the foot (medial metatarsal-phalanges line). A third flex groove is aligned with a line which extends along the second through fifth metatarsal-phalanges joints (lateral metatarsal-phalanges line). The second and third grooves join one another adjacent to the medial side of the sole at a location adjacent the first metatarsal-phalanges joint and extend completely across the width of the sole.

The formation of the spike plate into a single piece sole with permanently attached cleats of a softer material results in a uniquely advantageous track shoe. Since the entire base or major surface of the sole is formed of a relatively hard material, the stability and tortional rigidity of the sole is enhanced. However, by forming the cleats of a second, less hard, material, the cleats provide a degree of cushioning. Furthermore, the spike fasteners are located so as to accommodate flex grooves aligned both along the medial metatarsal-phalanges line and the lateral metatarsal-phalanges line, whereby the flexibility of the spike plate is enhanced. Traction and flexibility are further enhanced by a pair of lateral traction extensions which are formed integral with the plate and extend upward along the side of the upper adjacent the fifth metatarsal-phalanges joint. The traction extensions are separated by a gap which is aligned with the lateral end of the second groove. The softer cleats extend from the spike plate-sole rather than from a webbing or backing of resilient material which overlays a spike plate. In this manner, the weight of the sole is kept low, while still accomplishing stability and cushioning as discussed above.

Various advantages and features of novelty which characterize the invention are pointed out with particularity in the claims annexed hereto and forming a part hereof. However, for a better understanding of the invention, its advantages, and objects obtained by its use, reference should be made to the drawings which form a further part hereof, and to the accompanying descriptive matter, in which there is illustrated and described a preferred embodiment of the invention.

DETAILED DESCRIPTION OF THE INVENTION

Figure 1:
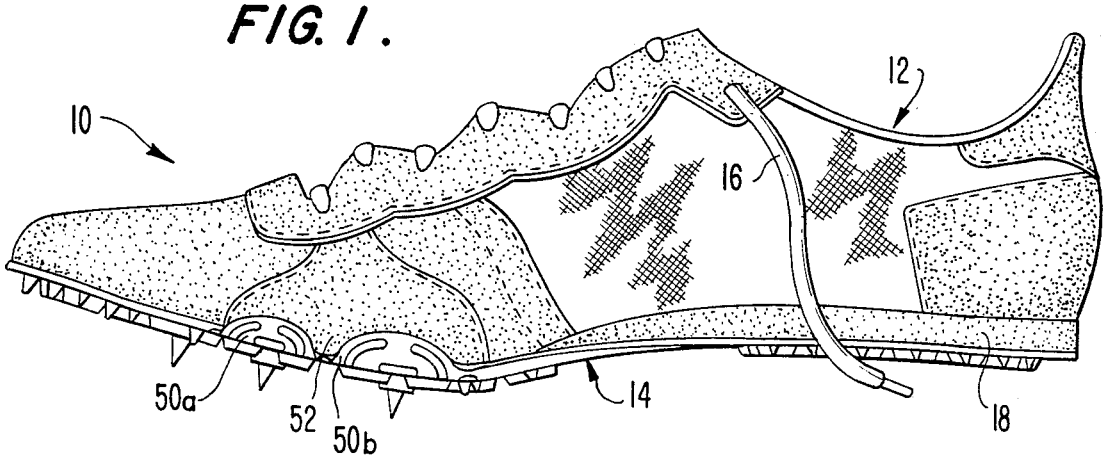
FIG. 1 is a side elevational view of a track shoe in accordance with the present invention.
Figure 2:
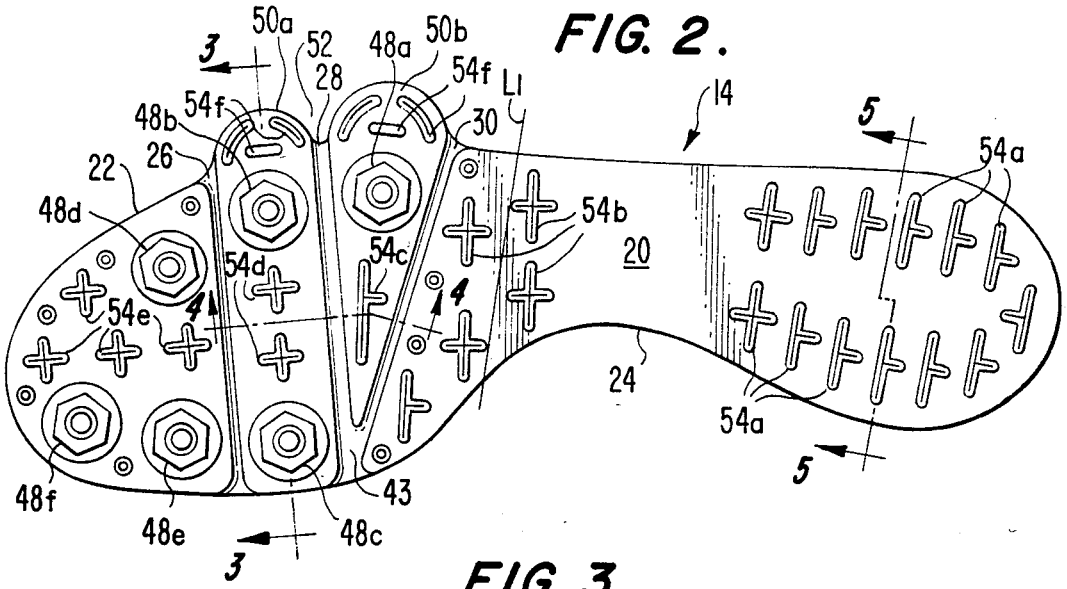
FIG. 2 is a bottom plan view of a spike plate-sole in accordance with the present invention.

Referring to the drawings, wherein like numerals indicate like elements, that is shown in FIG. 1 a track shoe designated generally as 10. Track shoe 10 includes an upper 12 and a sole 14. Upper 12 can be formed as any conventional upper, in particular an upper adapted for use in a track shoe, and includes lace holes along the throat of the upper to accommodate laces 16. A midsole 18 formed of a resilient shock absorbing material may be included in sole 14 along the heel and arch area of the shoe. Midsole 18 is relatively thin, i.e. thinner than a midsole of a training shoe.

Sole 14 is formed of a plate or base 20 which extends along substantially the entire length of shoe 10. Sole 14 and plate 20 can be broadly divided into a forepart section 22 forward of line L-1 and a rearpart section 24 rearward of L-1. Line L-1 is intended to be diagramatic and not to indicate a precise line of demarcation between a forepart section and a rearpart section. However, generally the forepart section includes the area of shoe 10 beneath the toe and the ball of the foot of a wearer, and the rearpart section includes the portion of the shoe below the arch and heel of a wearer.

Figure 3:
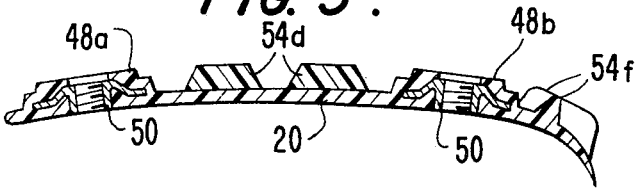
FIG. 3 is a cross-sectional view taken generally along the line 3—3.
Figure 4:
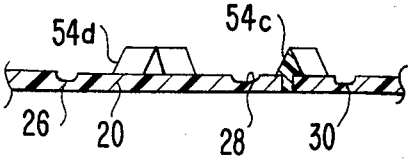
FIG. 4 is a cross-sectional view taken generally along lines 4—4 of FIG. 2.
Figure 5:
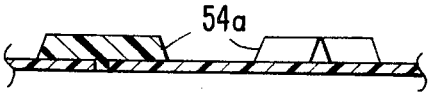
FIG. 5 is a cross-sectional view taken generally along lines 5—5 of FIG. 2.

Plate 20 is preferably formed of a relatively hard material such as nylon, having a Shore A durometer hardness in the range of 105 to 115. A nylon 11, P40 has been found suitable. As seen in the cross-section of FIGS. 3-5, plate 20 is thinner in rearpart section 24 (FIG. 5) and is thicker in forepart section 22 (FIGS. 3 and 4). For example, plate 20 can have a thickness of approximately one mm in rearpart section 24 and two mm in forepart section 22.

Figure 6:
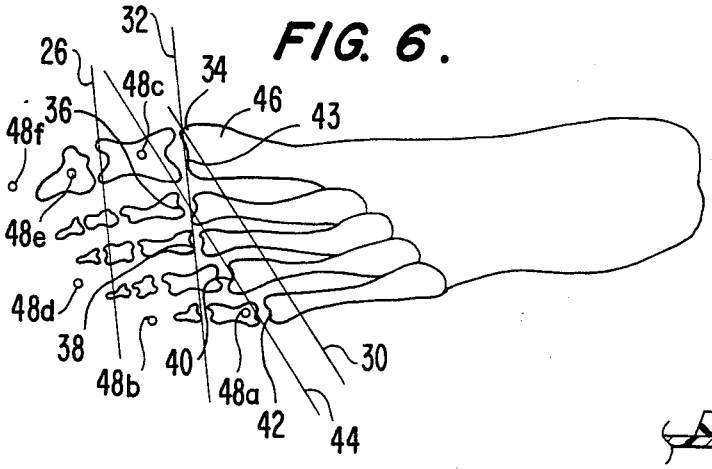
FIG. 6 is a diagramatic top plan view of the bones of a foot illustrating the medial and lateral metatarsal-phalanges lines and the alignment of the flex grooves.

A plurality of flex grooves, 26, 28 and 30 are formed in plate 20 within forepart section 22, and extend laterally across substantially the entire width of plate 20. Grooves 26, 28 and 30 reduce the thickness of plate 20 to approximately half that of the surrounding area of the plate. Grooves 26 and 28 are substantially parallel to one another and are aligned with a medial metatarsal-phalanges joint line 32 which extends between the first and second metatarsal-phalanges joints 34 and 36, as illustrated in FIG. 6. Groove 30 is substantially parallel to or aligned with a lateral metatarsal-phalanges joint line 44 which extends along the second through fifth metatarsal-phalanges joints 36, 38, 40 and 42 respectively. Groove 28 is substantially co-extensive with medial metatarsal-phalanges joint line 32 and groove 26 is located forward thereof and in the area of the interphalanges joints. Groove 30 is located rearward of groove 28 and joins with groove 28 adjacent to the medial side of sole 14 at area 43, as illustrated in FIG. 3. Area 43 is located approximately at the first metatarsal-phalanges joint 34, as illustrated in FIG. 6. Flex lines 26, 28 and 30 enhance the flexibility of plate 20 along two flex planes or lines through which the foot moves.

A plurality of spike fasteners 48A-48F are located in forepart section 22. Each fastener 48, includes a projection from plate 20 and a threaded socket 50 held within the projection for threadingly receiving a metal spike. The projections are illustrated as formed of the same material as plate 20. Alternatively, the projections can include an interior portion formed of another, harder material, such as a harder grade nylon which is formed integral with plate 20. Rearwardmost fastener 48A is located between grooves 28 and 30, and is adjacent to the lateral side of plate 20. Fasteners 48B and 48C form a first pair of fasteners which are located between grooves 26 and 28, with fastener 48B located adjacent to the lateral side of plate 20 and fastener 48C adjacent to the medial side of plate 20. Fasteners 48D and 48E form a second pair of fasteners which are located immediately forward of groove 26, with fastener 48D located adjacent the lateral side of plate 20 and fastener 48E adjacent the medial side of plate 20. Fastener 48F is the forwardmost fastener and is located adjacent the medial forward tip of plate 20. The approximate location of fasteners 48A-48F with respect to the bones of a foot are illustrated as circles in FIG. 6.

A pair of lateral traction extensions 50A and 50B are formed integral with plate 20 and extend upwardly from the bottom surface of plate 20 and around the lateral side of the upper adjacent the fifth metatarsal-phalanges joint 42. Traction extension 50A is located forward of joint 42 while extension 50B is located approximately next to join 42. A gap 52 separates traction extensions 50A and 50B. Gap 52 is aligned with the lateral end of groove 28, and further enhances the flexibility of plate 20.

A plurality of cleats 54A-F are formed integral with and permanently attached to plate 20. However, cleats 54 are formed of a different material from that of plate 20. Cleats 54 are formed of a material which is less hard than the material of which plate 20 is made. In this manner, the cleats can enhance the shock absorbency of sole 14. For example, cleats 54 can be made of a softer grade nylon, such as nylon 11, P20 with a hardness in the range of 80 to 90 durometer on the Shore A scale.

Each cleat 54 has a generally forward facing traction surface, and to a lesser extent a laterally facing traction surface. Cleats 54 also have a generally triangular cross-section extending from a broad base at plate 20 to an apex. Cleats 54 preferably have a height of approximately 4 mm. Cleats 54A are located about the perimeter of the heel area. Cleats 54B are located in the rear portion of the ball area and the forward portion of the arch area. Cleat 54C is located between the grooves 28 and 30 and to the medial side of cleat fastener 48A. Cleats 54D are located between grooves 26 and 28 and between cleat fasteners 48B and 48C. Cleats 54E are located forward of groove 26 and between cleat fasteners 48D, 48E and 48F. As best seen in FIG. 3, cleats 54D have approximately the same thickness or height as the fastener projections from plate 20. The thickness or heights of cleats 54C and 54E are similarly approximately the same as the projections which define cleats 48A and 48D-F. Cleats 54C-E thus function as a bridge between the fasteners to provide support to the center portion of the foot between the fasteners. Cleats 54F extend from traction extensions 50A and 50B and serve as ground engaging elements along the outside of the ball of the foot.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principal of the invention, to the full extent intended by the broad general meaning of the terms in which the appended claims are expressed.

I claim:

1. A sole for a track sole comprising a plate formed of a first material extending along substantially the entire length of the sole, a plurality of traction cleats permanently attached to said plate, a plurality of spike fasteners attached to the forepart portion of said plate, a pair of lateral traction extensions extending upward from said plate, one of said traction extensions being located adjacent to the fifth metatarsal-phalanges joint and the other of said traction extensions being located forward of the fifth metatarsal-phalanges joint, said lateral traction extensions being separated from one another by a gap, first, second and third flex grooves being formed in said plate to enhance the flexibility of said plate along said grooves, said first flex groove extending parallel to a line between said first and second metatarsal-phalanges joints, said second flex groove extending generally along a line between said first and second metatarsal-phalanges joints and parallel to said first flex groove and being located rearward thereof, said third flex groove extending substantially parallel with a line extending along the second through fifth metatarsal-phalanges joints, said second and third grooves joining along the medial side of said sole, and said second groove extending across said plate to said gap between said lateral traction extensions.

2. A sole for a track shoe in accordance with claim 1 wherein said cleats include cleats extending from said lateral traction extensions.

3. A sole for a track shoe in accordance with claim 1 wherein said cleats include cleats in the area between said fasteners with a height substantially equal to the height of said fasteners.

4. A sole for a track shoe in accordance with claim 1 wherein said fasteners include a rearwardmost fastener, a forwardmost fastener and first and second pairs of transversely aligned fasteners, said rearwardmost fastener being located between said second and third flex grooves and adjacent the lateral side of said sole, said first pair of fasteners being located between said first and second flex grooves and on opposite sides of said sole, said second pair of fasteners being located forward of said first flex groove and on opposite sides of said sole, and said fowardmost fastener being located adjacent the medial forward tip of said sole.

5. A sole for a track shoe in accordance with claim 3 wherein said plate is formed of nylon and said cleats are formed of softer grade nylon.

6. A sole for a track shoe in accordance with claim 3 wherein said cleats include heel cleats in the heel area of said sole.

7. A track shoe comprising an upper and a sole attached to said upper, said sole including a plate formed of nylon extending along substantially the entire length of the shoe, a plurality of traction cleats permanently attached to said plate and formed of a softer grade nylon, a plurality of spike fasteners attached to the forepart portion of said plate, a pair of lateral traction extensions extending upward from said plate adjacent to and forward of the fifth metatarsal-phalanges joint, said lateral traction extensions being separated from one another by a gap, first, second and third flex grooves being formed in said plate to enhance the flexibility of said plate along said grooves, said first flex groove extending parallel to a line between said first and second metatarsal-phalanges joints, said second flex groove extending generally along a line between said first and second metatarsal-phalanges joints and parallel to said first flex groove and being located rearward thereof, said third flex groove extending substantially parallel with a line extending along the second through fifth metatarsal-phalanges joints, said second and third grooves joining along the medial side of said sole, said second groove extending across said plate to said gap between said lateral traction extensions, said fasteners including a rearwardmost fastener, a forwardmost fastener and first and second pairs of transversely aligned fasteners, said rearwardmost fastener being located between said second and third flex grooves and adjacent the lateral side of said sole, said first pair of fasteners being located between said first and second flex grooves and on opposite sides of said sole, said second pair of fasteners being located forward of said first flex groove and on opposite sides of said sole, and said forwardmost fastener being located adjacent the medial forward tip of said sole.

8. A track shoe in accordance with claim 7 wherein said plate has a thickness greater in said forepart portion than in the remainder of said sole.

9. A track shoe in accordance with claim 8 wherein said plate has a thickness of approximately 2 mm in said forepart portion and 1 mm in the remainder of said sole.

10. A track shoe in accordance with claim 7 wherein said plate has a hardness of approximately 105 in 115 durometer on the Shore A scale and said cleats have a hardness of approximately 80 to 90 durometer on the Shore A scale.

* * * * *